US006794568B1

(12) United States Patent
Callaway

(10) Patent No.: US 6,794,568 B1
(45) Date of Patent: Sep. 21, 2004

(54) DEVICE FOR DETECTING MUSICAL GESTURES USING COLLIMATED LIGHT

(76) Inventor: Daniel Chilton Callaway, 1310 Taylor St., San Francisco, CA (US) 94108

( * ) Notice: Subject to any disclaimer, the term of this patent is extended or adjusted under 35 U.S.C. 154(b) by 34 days.

(21) Appl. No.: 10/441,537

(22) Filed: May 21, 2003

(51) Int. Cl.[7] ..... G10H 3/06
(52) U.S. Cl. ..... 84/724; 84/477 B
(58) Field of Search ..... 84/724, 477 B

(56) References Cited

U.S. PATENT DOCUMENTS 4,980,519 A 12/1990 Matthews
5,017,770 A * 5/1991 Sigalov ..... 250/221
5,648,627 A * 7/1997 Usa ..... 84/600
5,808,219 A * 9/1998 Usa ..... 84/600
5,875,257 A * 2/1999 Marrin et al. ..... 382/107
5,998,727 A 12/1999 Takahashi
6,142,849 A * 11/2000 Horton et al. ..... 446/175
6,489,550 B1 * 12/2002 Takahashi et al. ..... 84/724

* cited by examiner

*Primary Examiner*—Jeffrey W Donels

(57) ABSTRACT

A musical apparatus that outputs a musical control signal modulated in real-time by the interruption of laser beams in an operational space. These interruptions of laser beams are transduced by appropriate circuitry into electrical signals common to electronic musical equipment, for example MIDI clock data. The signals may be used to control the tempo of a musical performance, or may control some other parameters. The system includes interpretive circuitry for recognizing gestures from the accepted canon of musical conducting.

12 Claims, 10 Drawing Sheets

DEVICE FOR DETECTING MUSICAL GESTURES USING COLLIMATED LIGHT

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO COMPUTER PROGRAM LISTING COMPACT DISC APPENDIX

A source code appendix, Appendix A, is included. This appendix resides on two duplicate CD-R discs. The discs are entitled "Callaway Appendix A," and each disc contains two ascii-format source code files for the Zilog Z8 microcontroller: "SOURCE.TXT," and "INCLUDE.INC."

BACKGROUND OF THE INVENTION

This invention is an apparatus that allows a musical conductor to practice conducting a piece of music with no orchestra present.

Modem and classical music can be transcribed into MIDI (Musical Instrument Digital Interface) computer files as 'digital' music. Unlike CDs or MP3s, MIDI files do not contain any actual sound data. MIDI files consist only of a list of note events, which are made into sounds by a synthesizer. For example, the opening phrase 'Happy birthday to you" would contain 6 discrete note events.

MIDI files contain multiple instruments, where an instrument consists of a specific list of note events. A string quartet MIDI file has four instruments, and therefore four distinct lists of note events. A solo piano MIDI file has only one instrument.

Synchronization—Controlling MIDI Tempo with an External Signai

A software MIDI player can play back music much like a CD player. A 'play' button in MIDI player software starts the music, and a 'stop' button ends it. During the playback, the note events for each instrument are sent separately to a synthesizer.

Popular software MIDI players allow flexible control of musical tempo for applications more complex than simple playback. One application that requires special tempo control is synchronization. Synchronization is necessary when a MIDI player must be locked in simultaneous playback with another machine. For example, a MIDI player can be synchronized to a video recorder. When the video recorder begins playback, it sends a control signal to the MIDI player. The control signal from the video recorder controls the speed (or tempo) of the MIDI player's playback. When the video recorder stops, the MIDI player stops. When the video player changes speeds, the control signal causes the MIDI player to change speeds as well. The control signal is made up of individual timing markers, or 'MIDI Beat Clocks.' MIDI Beat Clocks are subdivisions of musical beats. Every musical beat is subdivided into twenty-four MIDI Beat Clocks. This means that the video recorder, or other controlling machine, must send exactly twenty-four MIDI Beat Clocks for the MIDI Player to advance its music by one beat.

Using Synchronization to Allow Real-Time Human Conducting

A human conductor can control the tempo of a MIDI file with a device that generates synchronization data. A conducting device allows a user to establish tempo in real time, with the music following in synchronization. The conducting device translates this activity into MIDI Beat Clocks, which are sent to a MIDI player. The MIDI player derives its tempo from the incoming MIDI Beat Clocks as if it were synchronized to a video recorder. When the user speeds up the tempo, the MIDI Time Code also speeds up, and the MIDI player plays back the music more quickly.

Devices that Generate MIDI Beat Clocks

Over the last 20 years, conducting devices have been popular projects in the academic world. However, very few conducting devices have been brought to market. No conducting device that has been introduced has been widely embraced by musicians. However, other electronic instruments flourish in the marketplace. Digital pianos, wind instruments, and motion-detecting sound modules such as the Theremin are in wide use among modern musicians.

The Radio Baton

A system for tracking musical gestures, disclosed in 1990 in U.S. Pat. No. 4,980,519 by Matthews, incorporated batons that contained radio transmitters. As the batons moved about in three-dimensional space, their motion was detected by an 'antenna board' lying beneath them. The antenna board received signals sent from the two batons using multiple radio receivers. By comparing the relative strength of the received signals, a computer could calculate XYZ position coordinates for the two batons. This position data was sent as a control signal to a computer running musical software. The control signal could be configured to govern a variety of musical signals, including tempo. The complexity of this system caused it to be expensive.

Lightning II

The 'Lightning II' MIDI controller was a baton-based system for tracking motion and gestures. It operated by deriving XYZ position coordinates from strobing LEDs. Two handheld batons each contained LEDs that strobed at unique fixed frequencies. An external array of optical sensors used triangulation to calculate XYZ position coordinates for the two batons. This system was expensive and fragile, and the batons were so heavy as to be objectionable to musical conductors. (see http:/www.buchla.com/lightning/descript.html)

The Digital Baton

A hand-held conducting device, disclosed in 1999 in U.S. Pat. No. 5,875,257 by Marrin, used internal accelerometers and strobing LEDs to detect conducting gestures. The device provided multiple control signals for the conducting of music, including tempo and volume. This system used a heavy baton, so that it could not accommodate extended conducting sessions.

The Conductor's Jacket

A custom-fitted jacket, developed by Nakra, contains biometric sensors. The jacket measures body motion and muscle action, and a computer combines these measurements to create a control signal. The control signal is used to govern a variety of musical parameters in live performance, including tempo, volume, and dynamics. This system is expensive and requires heavy calibration for each user. (see http:/web.media.mit.edu/~marrin/CIM.htm)

Roland Dimension Beam

A system that detected the position of a hand in an operational space was disclosed in 1998 in U.S. Pat. No. 5,998,727 by Takahashi et al. The system used optical sensors to collect light reflected from the hand, and estimated the position of the hand through a process of triangulation. The system allowed a user to define specific MIDI parameters, and to control them with the signal generated through the optical triangulation. Both the sources of light and the optical detectors were contained in a single enclosure. Because of the crude method of triangulation used to detect the position of the hand, this system allowed only rough control of analog parameters, and not precise triggering of events. Triggering was particularly infeasible if a baton, instead of a hand, was used.

Every system that has been designed for conducting to date has suffered from some combination of the following disadvantages:

Heavy or bulky interfaces

Elements that must be worn on the body

Poor tracking of beats (i.e. beats are missed or skipped)

High cost ($1,200–$20,000)

Complex hardware installations

A user's most common objection to a conducting device is typically its weight. Conducting a symphony or opera can be a 4-hour endeavor, and conductors often favor super lightweight batons in performance. Some conductors decline to use batons, even though this makes them less visible to musicians. The handheld component of most conducting devices weigh over 10 ounces, while a conductor's baton weighs 1–5 ounces.

Objects and Advantages

In contrast to past efforts, the present device distinguishes itself by:

a. Allowing the user to hold any baton, or no baton;

b. Enabling simple manufacture and calibration, with few complex assembly steps or parameters requiring calibration;

c. Manufacturability at a cost typical of digital instruments (e.g. keyboards)

d. Providing lower sensitivity to false triggers.

e. Providing high beat resolution. Whether the musical gestures are made rapidly or very slowly, triggering is consistent.

SUMMARY OF THE INVENTION

The present invention comprises a device for detecting the gestures of a musical conductor. The system uses a laser beam projected into an optical sensor. When a conductor's baton breaks the laser beam, the device sends a control signal to a computer.

BRIEF DESCRIPTION OF THE DRAWINGS

The foregoing discussion will be understood more readily from the following detailed description of the invention, when taken in conjunction with the accompanying drawings, in which.

| LIST OF REFERENCE NUMBERALS | |
|---|---|
| 100 | laser projector |
| 102 | vector laser beam |
| 104 | horizontal laser beam |
| 106 | vertical laser beam |
| 108 | collimated laser diode |
| 110 | conductor's baton |
| 200 | tower |
| 202 | mirror |
| 204 | pivot |
| 206 | armature |
| 208 | base |
| 300 | tower |
| 302 | mirror |
| 304 | pivot |
| 306 | armature |
| 308 | base |
| 400 | laser detector |
| 402 | aperture |
| 406 | MIDI connector |
| 410 | power LED |
| 420 | 'laser alignment' LED |
| 430 | 'first beat' LED |
| 450 | mode switch |
| 500 | set of '4/4' gestures |
| 510 | first beat |
| 520 | second beat |
| 530 | third beat |
| 540 | fourth beat |
| 600 | set of '3/4' gestures |
| 610 | first beat |
| 620 | second beat |
| 630 | third beat |
| 700 | optical sensor |
| 702 | one-shot trigger |
| 704 | sequential logic |
| 706 | timer |
| 708 | divider |
| 710 | MIDI Encoder |
| 712 | computer MIDI port |
| 714 | MIDI software player |

DETAILED DESCRIPTION OF THE INVENTION

The device incorporates systems and components relating to: Musical conducting, Laser optics, light reflection, light detection, analog circuits, microcontrollers, and MIDI (musical instrument digital interface)

Figure 1:
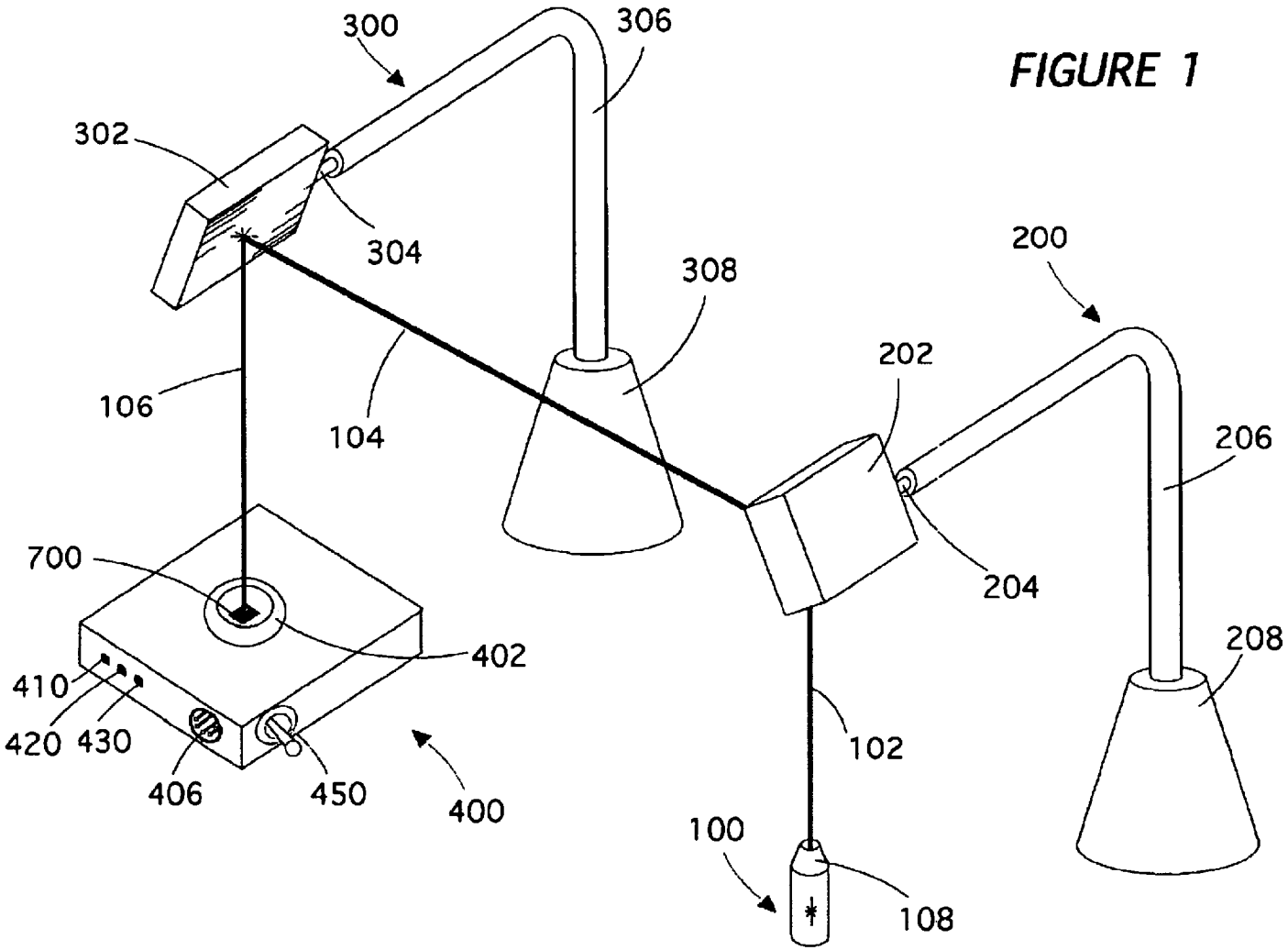
FIG. 1 is a perspective view of an apparatus for detecting conducting gestures in accordance with the invention.

FIG. 1 shows a perspective view of a preferred embodiment of the device.

A laser projector 100 contains a collimated laser diode 108 and projects a vertical beam of laser radiation 102 on to a mirror 202. Mirror 202 is positioned at an angle of 45? to vertical beam 102, and gives rise to a horizontal laser reflection 104, which is incident upon a mirror 302. Mirror 302 is positioned at an angle of 45? to horizontal reflection 104, and gives rise to a vertical laser reflection 106, which is incident upon an optical sensor 700 housed in a detection unit 400 and exposed through an aperture 402.

Two towers 200 and 300 are identical in construction, and suspend mirrors 202 and 302. Towers 200 and 300 should lie approximately 30 inches apart. Two supports 208 and 308 should be weighted appropriately so that they provide stability for the towers, or approximately five pounds. Two armatures 206 and 306 are right-angled sections of rigid material, for example steel, approximately 36 inches in total length, or 18 inches in each dimension. Rigidity of armatures 206 and 306 is critical because the incidence of laser reflection 106 upon optical sensor 700 relies upon a constant and invariant alignment of mirrors 202 and 302. Mirrors 202 and 302 are mounted on two rotary pivots 204 and 304, allowing alignment of the mirrors with respect to their incident laser beams 102 and 104. Pivots 202 and 302 should provide ample rotary resistance so that mirrors 202 and 302 can be adjusted by a hand, and so that they maintain their alignment after adjustment is complete.

Detection unit 400 is an enclosure with an aperture 402 on its top side. Aperture 402 exposes an upward-facing optical detector 700 that is electrically connected to the system of FIG. 2. Three LED indicators 410, 420, and 430 are mounted on one side of detection unit 400. An output connector 406 for transmission of MIDI (Musical Instrument Digital Interface) signals is mounted on one side of the detection unit.

Figure 2:
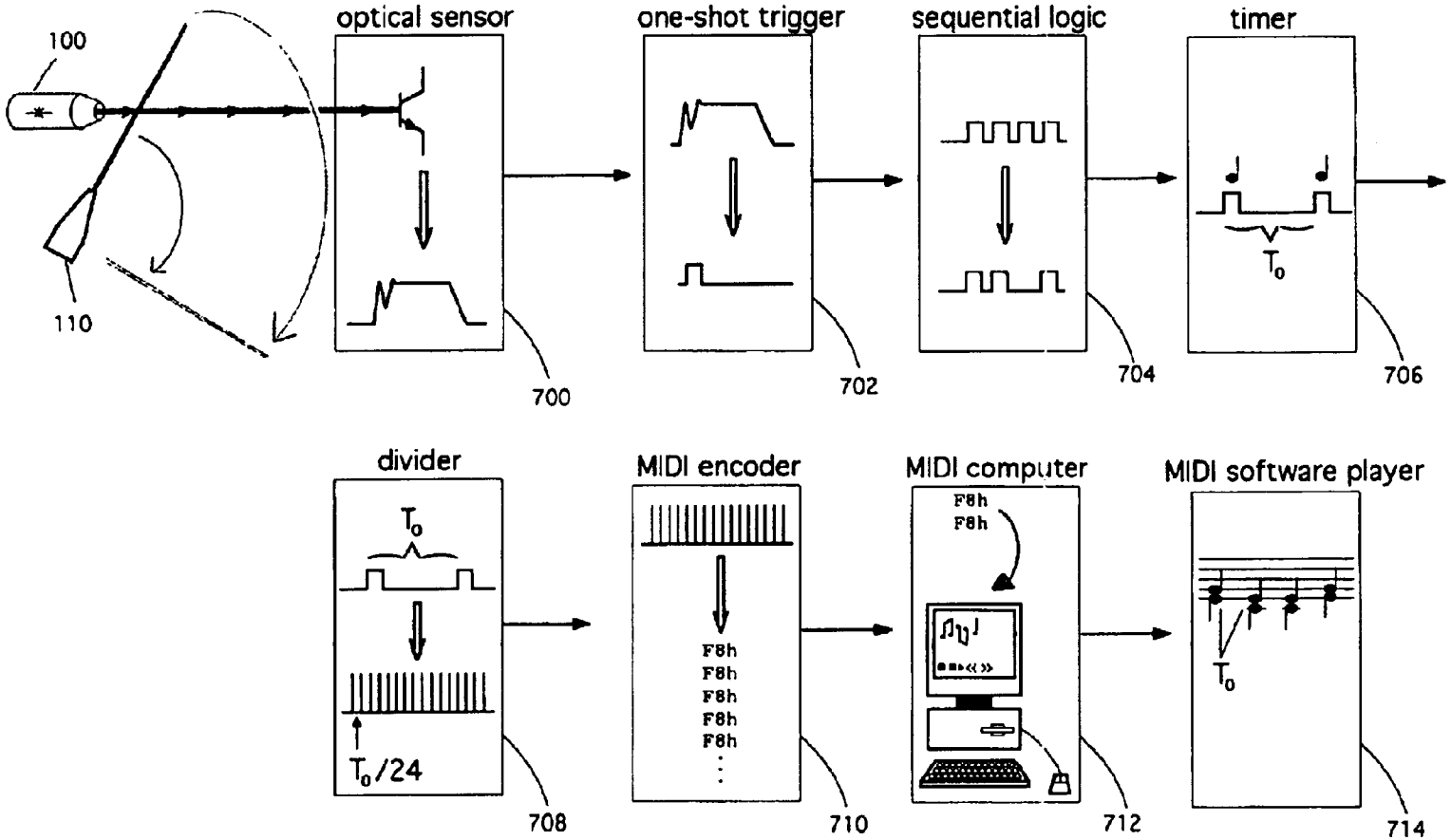
FIG. 2 is a schematic illustration of the operative components of a detection unit for use in the apparatus of FIG. 1.

Refer now to FIG. 2, a schematic illustration of the detection unit. Each of the elements [700, 702, 704, 706, 708, 710, 712, and 714] is serially interconnected, with the output signal of each element being transmitted to the next element as an input signal.

Note that throughout the remainder of the specification and claims, the terms 'interruptions' and 'laser interruptions' will be used frequently. In the context of the present apparatus, interruptions of laser beams 102, 104, and 106 arise from the intentional gestures of a user. These gestures may represent musical beats. For the systematic discussion of the apparatus, the terms 'interruptions' or 'laser interruptions' will always be used to discuss gestures made by the user.

The purpose of optical sensor 700 is to detect interruptions of laser beams 102, 104, and 106. The optical sensor must be configured so that it creates a distinct shift in output voltage when laser beams 102, 104, or 106 are interrupted. If the optical sensor is too sensitive to ambient light, its state will not change during laser interruptions. An acceptable realization of the optical sensor consists of a Fairchild Semiconductor L14G1 Hermetic Silicon Phototransistor configured in series with a pull-up resistor of resistance 60 k? and a supply voltage of 5 volts. When a laser beam is incident upon the phototransistor, the voltage at the node shared by the phototransistor and the resistor is 0 volts. When the laser beam is not incident upon the optical sensor, the voltage at same node is 5 volts. This configuration allows the detection of laser interruptions in environments of low to average ambient light. Optical sensor 700 is connected to LED indicator 420, which illuminates when vertical laser beam 106 is incident upon the optical sensor. LED 420 enables simple alignment and adjustment of the mirror pivots and laser beams, because it remains unlit when the laser beams are not correctly aligned.

The output of optical sensor 700 produces the input signal for a one shot trigger 702. The one-shot trigger exists to reject false triggers, or unintended interruptions of laser beams 102, 104, or 106. False triggers can occur if a hand or other object is used to interrupt the laser beams. When the hand passes through a laser beam, a trigger signal is generated when the first finger of the hand interrupts the laser. A second, spurious trigger can be generated by a second finger interrupting the laser. One-shot trigger 702 rejects this type of undesired trigger signal by the following method. Upon the occurrence of a trigger signal, the one-shot trigger transmits a fixed-width rectangular pulse. This pulse could be 1 ms in duration. During and after the transmission of the rectangular pulse, the one-shot trigger applies a holdoff window. The holdoff window is a period of time during which incoming trigger signals are ignored. The holdoff window could be 100 ms in duration. Thus, when a trigger signal occurs, one-shot 702 will reject spurious signals occurring less than about 100 ms after the trigger signal.

Figure 6:
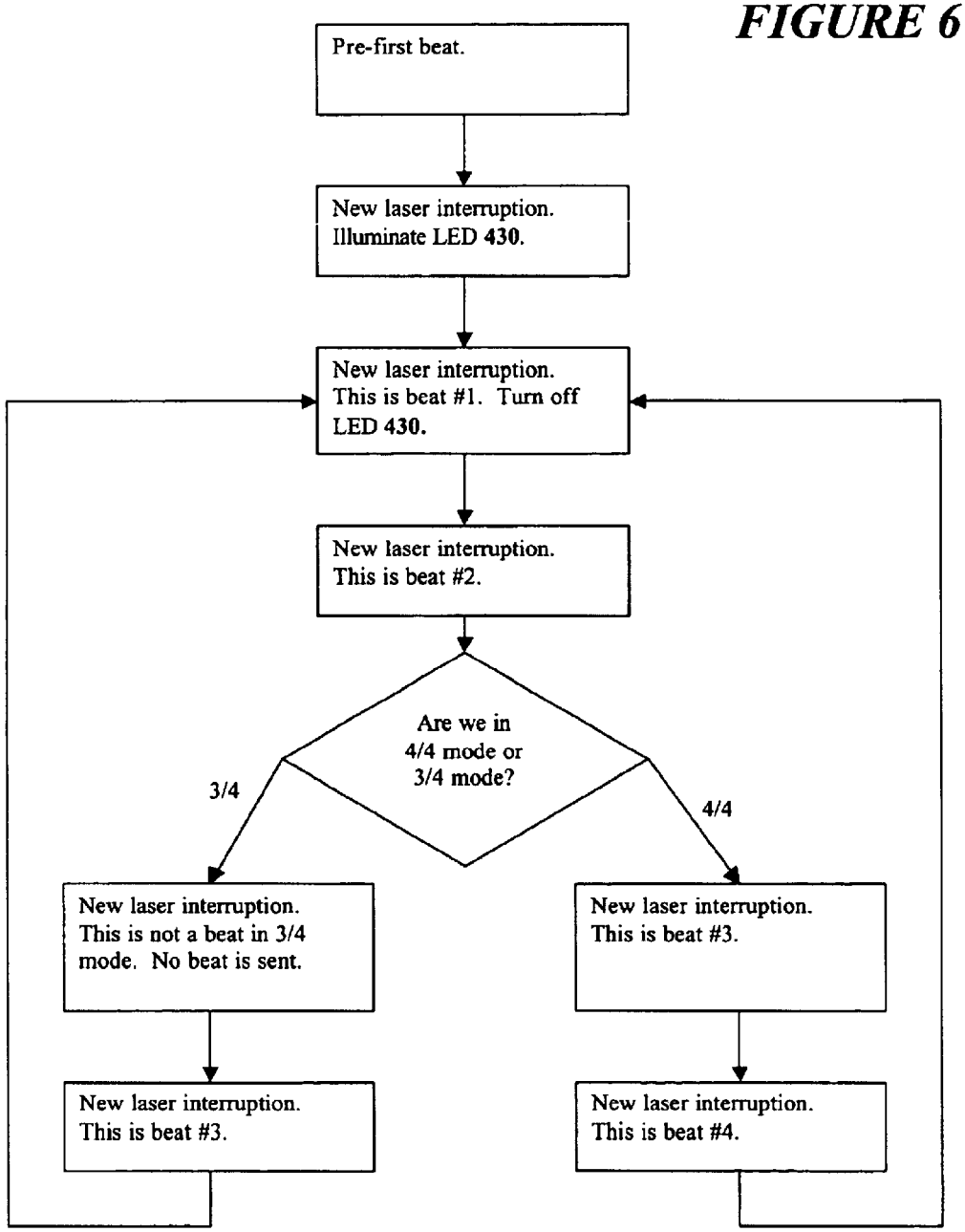
FIG. 6 is a logic flow diagram of the states of a system of sequential logic 704.

The output of one-shot 702 produces the input signal for a system of sequential logic 704. The sequential logic could also be called a finite state machine. The purpose of the sequential logic is to map a pattern of laser interruptions on to a sequence of musical beats. The sequential logic is able to propagate or permit laser interruptions that represent beats, while suppressing or ignoring laser interruptions that represent non-beats. FIG. 6 is a diagram showing the state transitions of the sequential logic. FIG. 6 shows the operation of the sequential logic in two distinct musical time signatures or 'modes': 3/4 mode (3 beats per measure) and 4/4 mode (4 beats per measure). The correct operational mode of the sequential logic is selected with a toggle switch 450, which has two positions. The two positions of the toggle switch are labeled '4/4' and '3/4.' An LED 430 is controlled by the sequential logic. This LED is called the 'first beat' LED and illuminates to notify the user that the next laser interruption will be mapped on to the first musical beat of the active musical time signature.

The output of sequential logic 704 produces an input signal for a timer 706. The purpose of the timer is to determine the elapsed time between two laser interruptions. Whenever the timer receives a stop signal, it measures the time elapsed since the preceding laser interruption. Every laser interruption causes the timer to stop, register its elapsed time, and immediately restart. The timer should be capable of measuring pulses as short as 200 ms, for a very fast tempo. It should also be capable of measuring pulses as long as 4 or 5 seconds, for a very slow tempo. The output signal transmitted by timer 706 is a measured time interval $T_x$. This interval can be represented as a digital signal.

The output of the timer produces an input signal for a divider 708. The purpose of the divider is to divide the time interval measured by timer 706 by the number twenty-four. Thus, the output of the timer is a time interval $T_x/24$.

The output signal of divider 708 is sent to a MIDI encoder 710. The MIDI encoder transmits one MIDI Beat Clock (F8 hexadecimal) for every elapsed time interval of $T_x/24$. Thus, the MIDI encoder transmits 24 MIDI Beat Clocks for every valid trigger signal received by optical sensor 700. Referring briefly to FIG. 6, the MIDI encoder can accommodate three distinct musical contingencies, as follows:

The output signal of divider 708 is sent to a MIDI encoder 710. The purpose of the MIDI encoder is to transmit 24 MIDI Beat Clocks for each laser interruption. During a given interval $T_x/24$, the MIDI Beat Clocks will be sent at intervals of $T_x/24$. Note that MIDI Beat Clocks are transmitted at a rate determined by the interval between the two most recent laser interruptions. As a result, the system 'predicts' the rate at which MIDI Beat Clocks should be transmitted on the basis of past information.

Consistent Tempo

Figure 8:
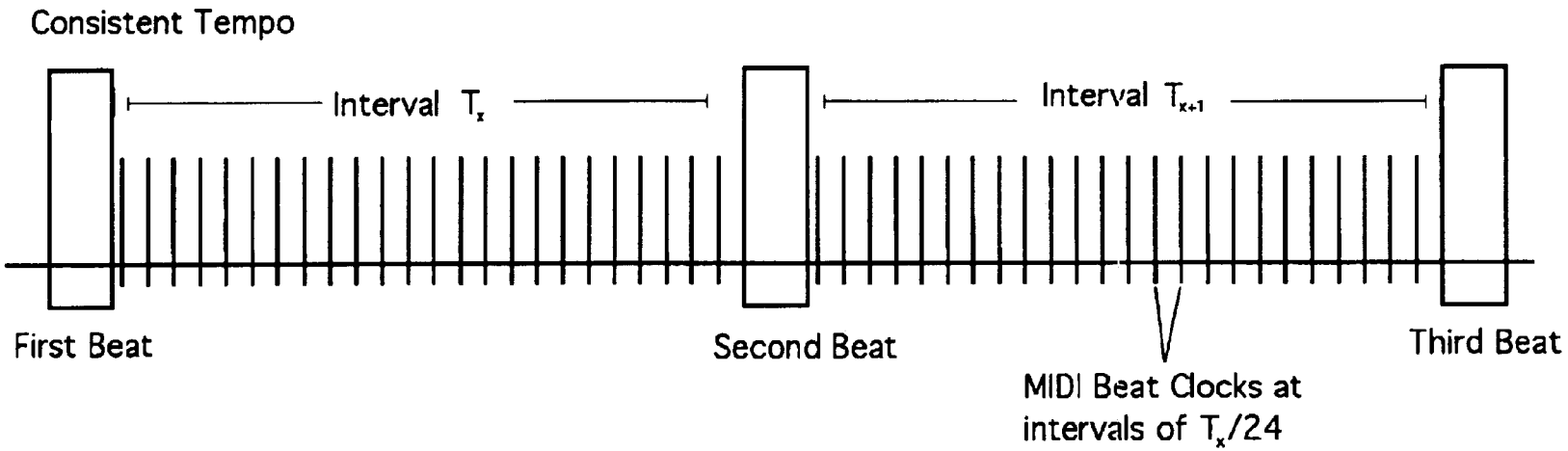
FIG. 8 is a graphical view of a 'consistent tempo' operational contingency.

When every laser interruption occurs exactly $T_x$ seconds after the preceding laser interruption, the relationship between laser interruptions and MIDI Beat Clocks will be similar to FIG. 8. In this contingency, the frequency at which MIDI Beat Clocks are transmitted is constant. However, the frequency of laser interruptions is an unknown signal generated by the user. Accordingly, the frequency of laser interruptions can increase and decrease.

Decreasing Tempo

Figure 9:
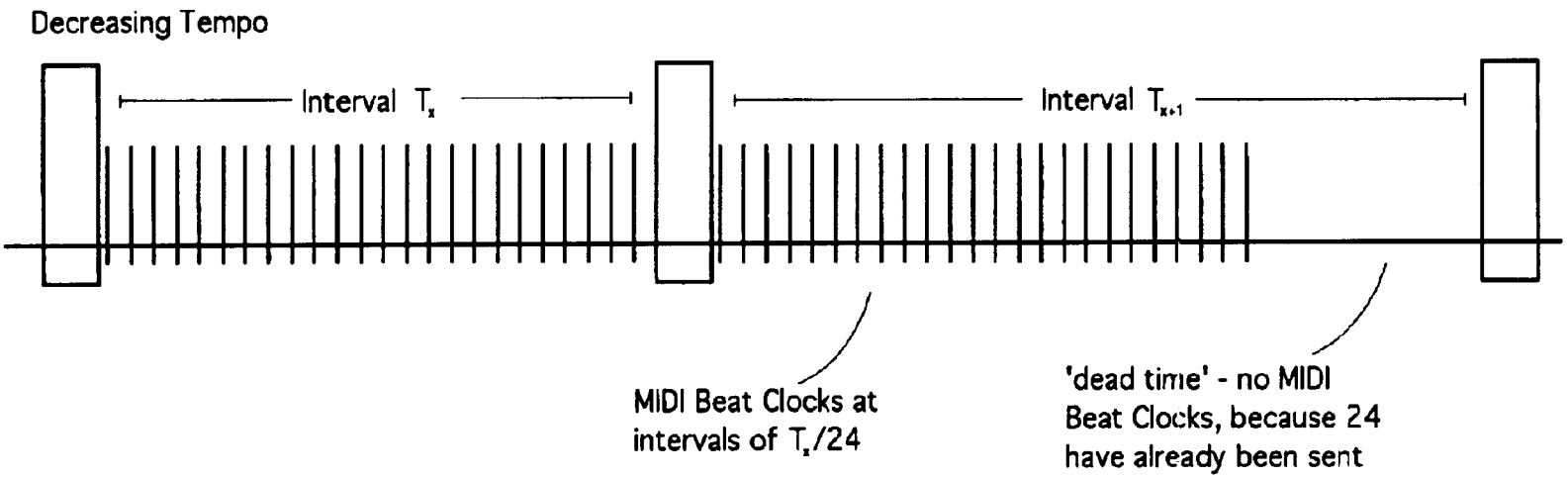
FIG. 9 is a graphical view of a 'decreasing tempo' operational contingency.

When the frequency of laser interruptions decreases, the relationship between laser interruptions and MIDI Beat Clocks will be similar to FIG. 9. In this contingency, two laser interruptions will occur at an interval of $T_x$. Following this, the MIDI Encoder will transmit 24 MIDI Beat Clocks at a frequency of $T_x/24$. In this contingency, the user will not issue a new laser interruption for some time after the MIDI Encoder has transmitted the 24 MIDI Beat Clocks. The entire time elapsed during the transmittal of the 24 MIDI Beat Clocks and the subsequent time until the user issues a new laser interruption is called interval $T_{x+1}$. Note that interval $T_{x+1}$ does not terminate until a new laser interruption occurs, resulting in the transmittal of the first MIDI Beat Clock of interval $T_{x+2}$.

Increasing Tempo

Figure 10:
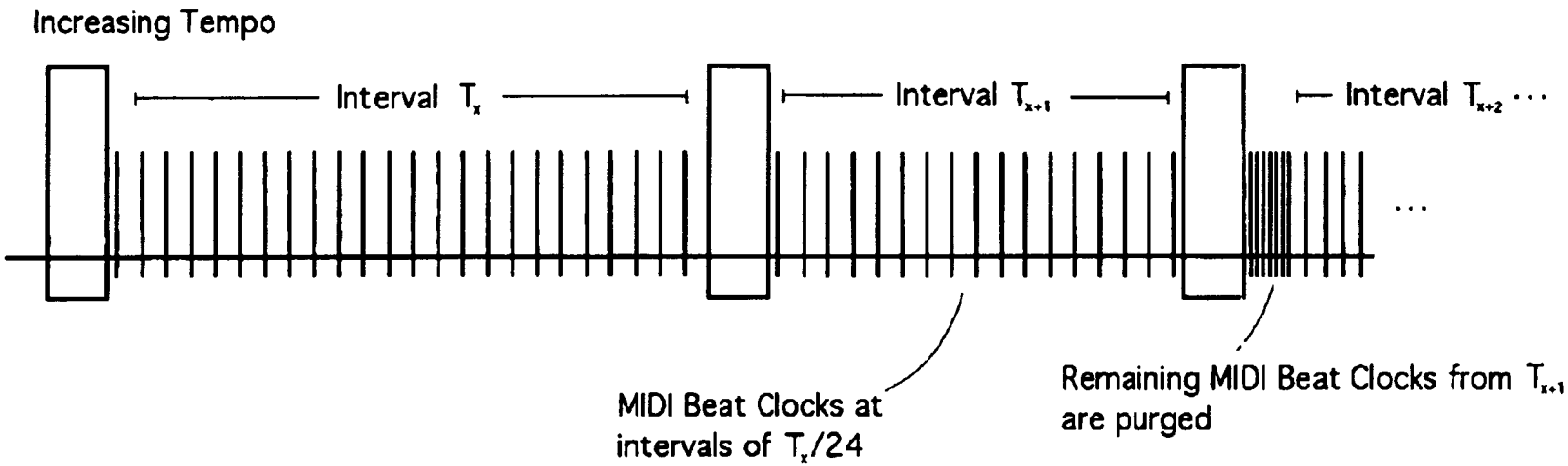
FIG. 10 is a graphical view of an 'increasing tempo' operational contingency.

When the frequency of laser interruptions increases, the relationship between laser interruptions and MIDI Beat Clocks will be similar to FIG. 10. In this contingency, two laser interruptions will occur at an interval of $T_x$. Following this, the MIDI Encoder will begin to transmit MIDI Beat Clocks at a frequency of $T_x/24$. However, the user will issue a new laser interruption before 24 MIDI Beat Clocks have been transmitted. This means that the user has 'demanded' that interval $T_{x+2}$ begin before interval $T_{x+1}$ has ended. To accommodate this, the MIDI Encoder immediately 'purges' the remaining MIDI Beat Clocks of interval $T_{x+1}$ by transmitting them at an absolute maximum frequency. For example consider FIG. 10. Interval $T_x$ determines the frequency of the MIDI Beat Clocks transmitted during interval $T_{x+1}$. However, after only 17 MIDI Beat Clocks, interval $T_{x+1}$ is interrupted by a new laser interruption. As a result, the MIDI Encoder immediately sends 7 MIDI Beat Clocks at a maximum rate of 3 MIDI Beat Clocks per millisecond. This completes the transmittal of the 24 MIDI Beat Clocks of interval $T_{x+1}$ in a delay too short for the user to perceive. After the transmittal of these 7 MIDI Beat Clocks, the MIDI Encoder begins transmitting a new group of MIDI Beat Clocks. This signifies the beginning of interval $T_{x+2}$. These MIDI Beat Clocks are transmitted at a rate determined by the length of interval $T_{x+1}$.

The MIDI Beat Clocks are transmitted via the MIDI protocol to a computer with MIDI input capability 712. The computer 712 delivers the MIDI Beat Clocks to a software MIDI player 714 capable of playing MIDI files and synchronizing to MIDI Beat Clocks. Software MIDI Player 714 uses the MIDI Beat Clocks to regulate the tempo of a pre-recorded MIDI file. For every 24 MIDI Beat Clocks it receives, the software MIDI player plays one beat of music from the pre-recorded MIDI file. Thus, the signal that is generated when the user interrupts the laser beams controls the tempo of a musical piece.

LED 410 is a power indicator, and illuminates when the device is powered.

Solid State Embodiment

The system of FIG. 2 can be realized using commercially available integrated circuits and passive circuit elements. Optical sensor 700 can be a phototransistor that becomes conductive when exposed to light. The optical sensor can be configured in series with a pull-up resistor of resistance 60 k? and a supply voltage of 5 volts. One-shot trigger 702 can be a typical IC non-retriggerable one-shot with an external RC network to determine the one-shot holdoff time. This holdoff time should be short enough to occur during a fast musical beat, and also long enough to reject spurious triggers from the optical sensor. A holdoff time of about 100 ms is appropriate. Spurious triggers might occur if a hand is used to interrupt the laser beams. When the hand passes through a laser beam, a first trigger can be derived from the first finger of the hand interrupting the laser. A second, spurious trigger can be generated by a second finger. One-shot trigger 702 rejects this second trigger.

Sequential logic 704 can comprise a binary counter that counts repeatedly up to the number of beats per measure in the musical composition and a network of combinational logic with a single output node. The combinational logic should be configured to produce a TRUE output signal when an interruption maps to an actual musical beat. The combinational logic should also produce a FALSE output signal when an interruption maps to a non-beat. The Boolean output of the combinational logic stage should drive one input of a two-input AND gate. The second input of the AND gate should be connected to the output of the one-shot trigger 702. Thus, the sequential logic discriminates every interruption of the laser beams. Interruptions that represent beats are propagated past the combinational logic. Interruptions that represent non-beats are systematically 'ignored' by the sequential logic.

The timer 706 can be a 16-bit digital counter that is both stopped and started by each non-ignored laser interruption. The output signal of the timer will be a digital signal representing the elapsed count $T_x$.

The divider 708 can be a clocked digital divider. The divider must be capable of accommodating a dividend of 16 bits. The divider must also be capable of completing a division operation quickly enough to accommodate a fast tempo, or approximately 5 ms. The output signal of the divider will be a digital signal representing the divided time $T_x/24$.

The MIDI encoder 710 can be a UART (universal asynchronous receiver/transmitter) common to the MIDI art. It should be capable of sending a MIDI Beat Clock for every quantity of elapsed time $T_x/24$.

The MIDI computer 712 can be any commercially available personal computer with an attached MIDI input means. MIDI input means might comprise a MIDI interface connected to the computer via USB, a serial cable, or a Firewire cable.

The MIDI software player 714 can be any commercially available MIDI application supporting synchronization via MIDI Beat Clocks or MIDI Realtime Messages. One such software player is Mark of the Unicorn's Performer.

Microcontroller Embodiment

A convenient embodiment of the invention uses a programmed microcontroller (e.g. the Zilog Z8) to incorporate the one-shot trigger 702, the sequential logic 704, the timer 706, the divider 708, and the MIDI encoder 710. Object code for the programming of such a device is included in an appendix.

In the microcontroller embodiment, the optical sensor is mapped to an interrupt vector. Whenever a laser interruption occurs, an interrupt routine runs and restarts a timer internal to the microcontroller.

The one-shot timer is incorporated into the microcontroller embodiment through a software 'wait' or 'delay' routine. This routine is executed every time a laser interruption occurs, and it causes subsequent laser interruptions to be ignored for some interval of time. A distinct advantage of the microcontroller embodiment of the conducting device is that the holdoff window can be scaled with the current tempo. Thus, for very slow tempos, when the user's hand or baton is likely to be moving very slowly, the holdoff time can be longer than for fast tempos.

Figure 5:
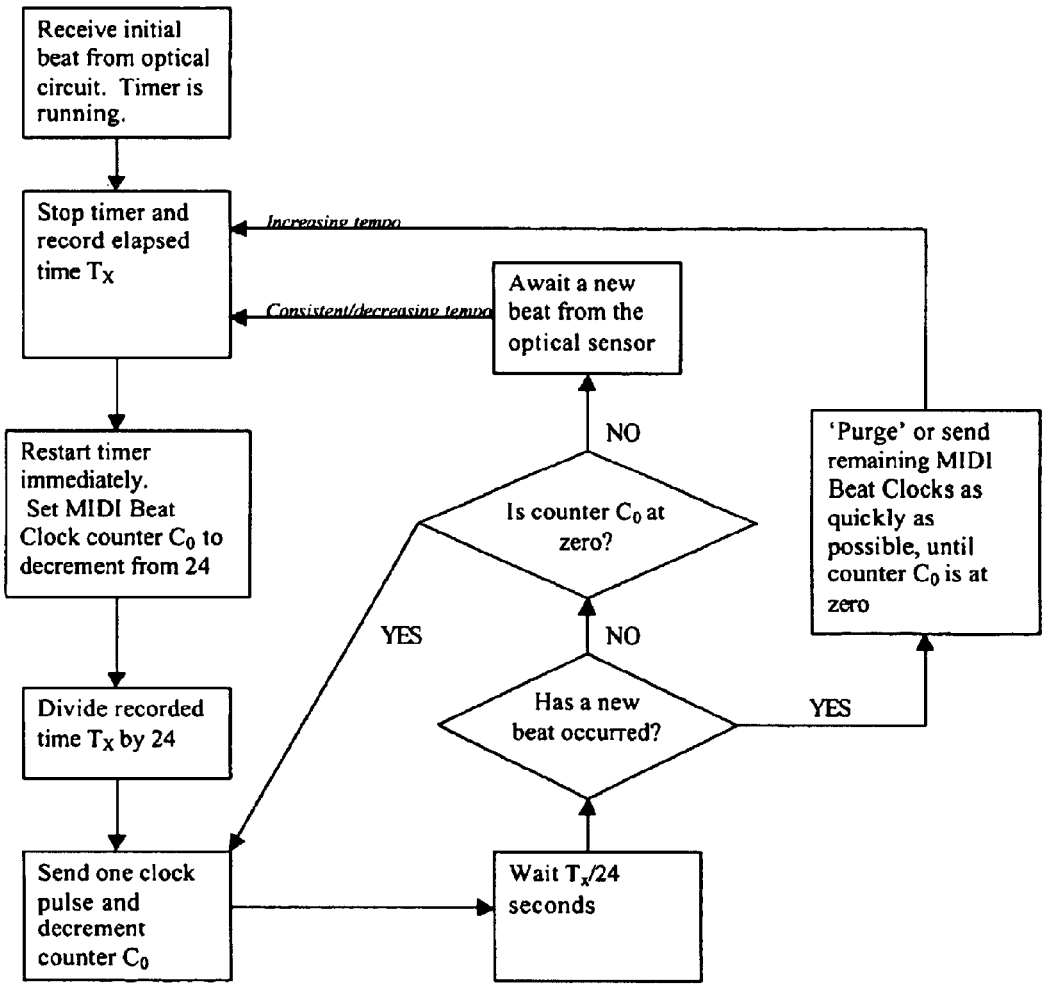
FIG. 5 is a logic flow diagram of a microcontroller embodiment of the conducting device.

The logic diagram of FIG. 5 is programmed into the microcontroller, so that the sequential logic 704 is incorporated.

Operation of the Invention

To conduct music with the device, the user begins by configuring the device components. The user positions the laser projector 100, the towers 200 and 300, and the laser receiver 400. The user then adjusts the pivots 202 and 302 so that the vertical laser beam 106 enters the aperture 402 of the laser receiver 400.

When configured, the device resembles the system of FIG. 1. The user toggles switch 450 into either its 4/4 setting or its 3/4 setting. For example, if the music were written in an 'even' time signature, (e.g. 4/4 or 4/2) the user would toggle the switch into 4/4 mode. If the music were written in an 'odd' time signature, (e.g. 3/2 or 3/4 or 6/8) the user would toggle the switch into 3/4 mode.

The following descriptions describe patterns typical to a musical conductor who is right-handed and conducts with her right hand. A conductor using left-handed gestures would reverse the left/right gestures outlined below. Some reference components are shown in FIG. 2.

Operation of an 'Even' Time Signature of Four Beats

Figure 3:
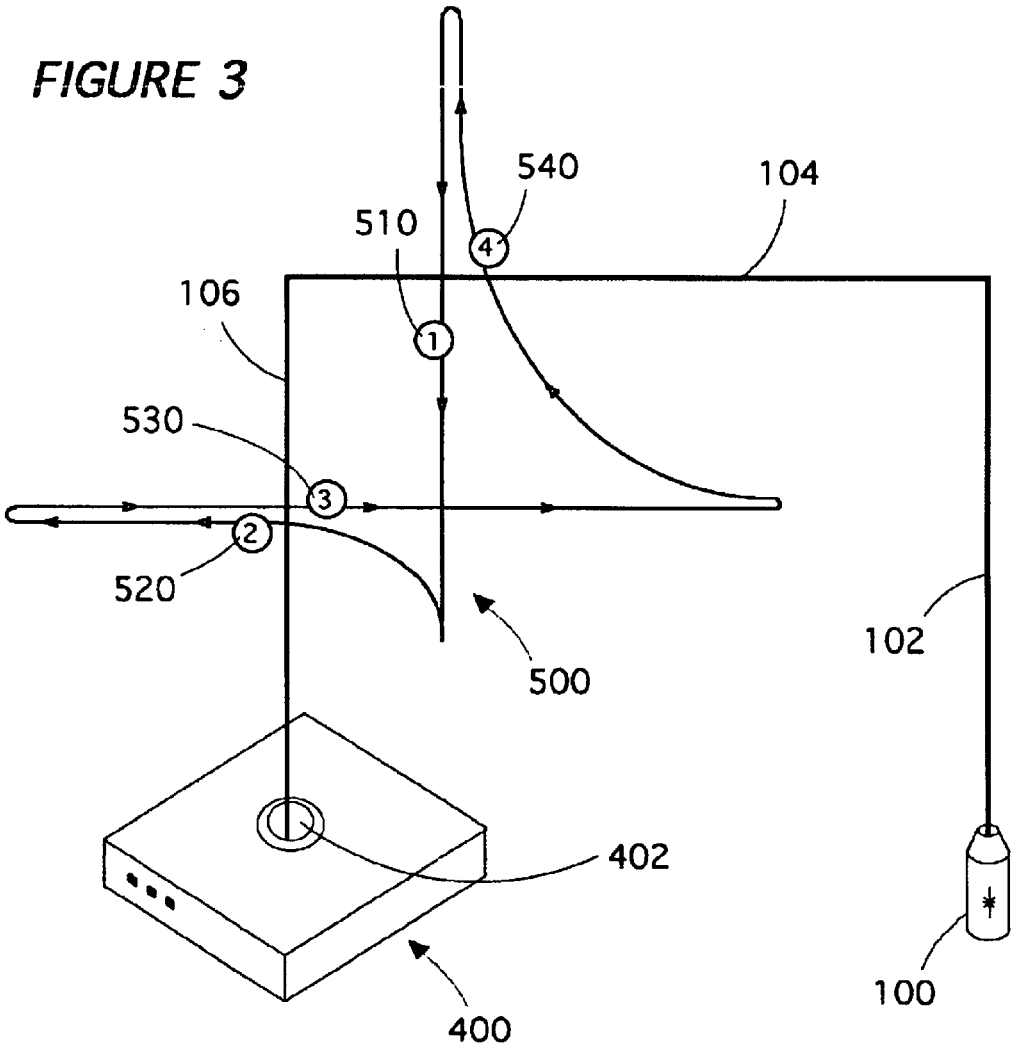
FIG. 3 diagrammatically illustrates a musical pattern of gestures called "4/4 time;"

The following description relates to a piece of music in the 4/4 time signature, as shown in FIG. 3. In this time signature, the musical beats are counted "1, 2, 3, 4, 1, 2, 3, 4 . . ." Each set of four beats constitutes a 'measure.'

The user interrupts the horizontal laser beam 104 with an initial upward stroke (x) of a hand or baton (x). This interruption does not represent an actual beat, but a preparatory beat. The interruption of horizontal beam 104 causes the voltage at the optical sensor to drop. This voltage drop functions as a control signal to start timer 706. The timer will record the elapsed time until the next interruption of the laser.

Next, the user delivers a downward (vertical) stroke 510 of the baton, interrupting horizontal laser beam 104. This stroke constitutes the first beat of the first measure of the musical passage. When the optical sensor transmits the control signal resulting from this stroke, the timer stops and restarts. The amount of time recorded by the timer constitutes the predicted duration of the first beat. MIDI Encoder 710 begins to send MIDI Beat Clock signals to computer 712 at a rate of 24 per beat, or one signal every (1/24) of the time recorded by the timer.

Next, the user delivers a left-moving (horizontal) stroke 520 of the baton, interrupting horizontal laser beam 106. This stroke constitutes the second beat of the first measure of the musical passage. When the optical sensor transmits the control signal resulting from this stroke, the timer stops and restarts. The amount of time recorded by the timer constitutes the predicted duration of the second beat. MIDI Encoder 710 begins to send MIDI Beat Clock signals to computer 712 at a rate of 24 per beat, or one signal every (1/24) of the time recorded by the timer.

Next, the user delivers a right-moving (horizontal) stroke 530 of the baton, interrupting horizontal laser beam 106. This stroke constitutes the third beat of the first measure of the musical passage. When the optical sensor transmits the control signal resulting from this stroke, the timer stops and restarts. The amount of time recorded by the timer constitutes the predicted duration of the third beat. MIDI Encoder 710 begins to send MIDI Beat Clock signals to computer 712 at a rate of 24 per beat, or one signal every (1/24) of the time recorded by the timer.

Next, the user delivers an upward (vertical) stroke 540 of the baton, interrupting horizontal laser beam 104. This stroke constitutes the fourth beat of the first measure of the musical passage. When the optical sensor transmits the control signal resulting from this stroke, the timer stops and restarts. The amount of time recorded by the timer constitutes the predicted duration of the fourth beat. MIDI Encoder 710 begins to send MIDI Beat clock signals to computer 712 at a rate of 24 per beat, or one signal every (1/24) of the time recorded by the timer.

The user has thusly conducted the first four beats (or first measure) of the musical passage. To begin the second measure of the piece, the user delivers a downward (vertical) stroke of the baton 510, interrupting horizontal laser beam 104. This stroke constitutes the first beat of the second measure. Each measure of the musical passage can be conducted using the fundamental four gestures outlined above. These gestures form the common pattern that musical conductors use to conduct music in 4/4 time signature.

Operation of an 'Odd' Time Signature of Three Beats

Figure 4:
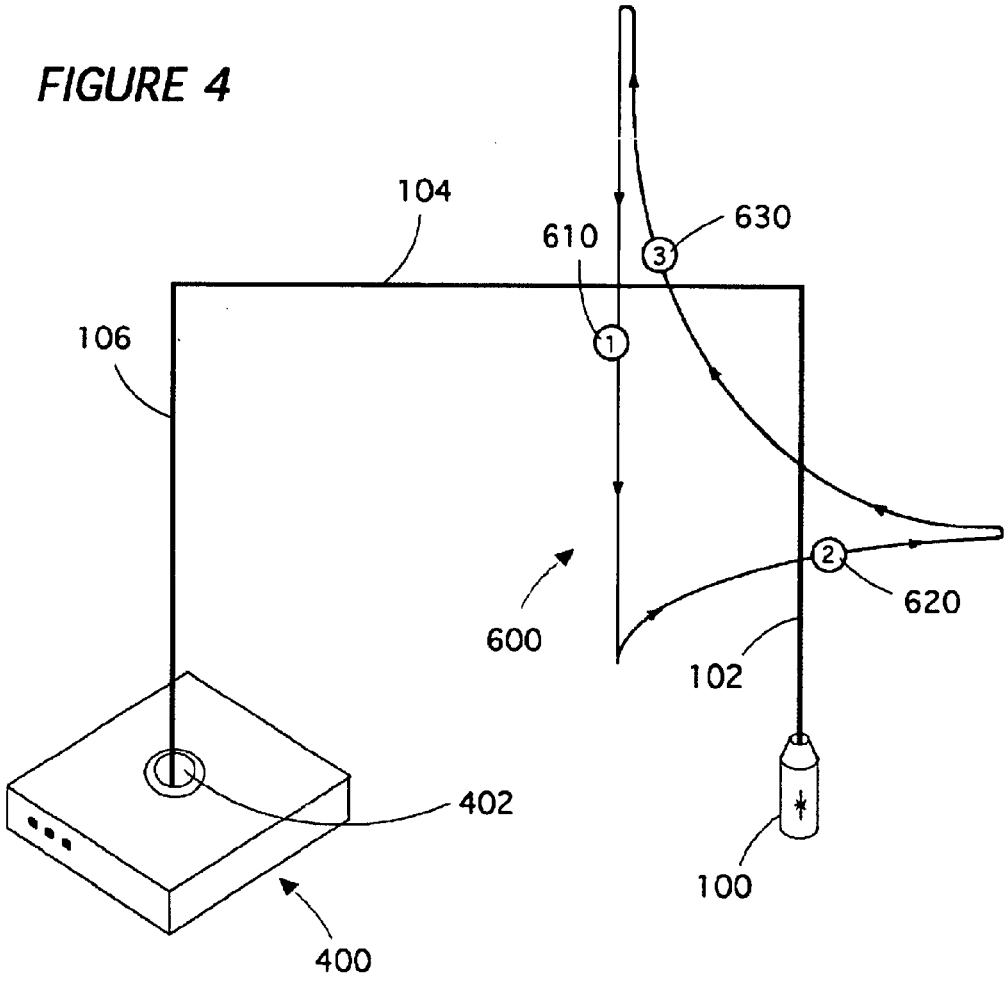
FIG. 4 diagrammatically illustrates a musical pattern of gestures called "3/4 time."

The following description relates to a piece of music in the 3/4 time signature, as shown in FIG. 4. In this time signature, the musical beats are counted "1,2,3,1,2,3 . . ." Each set of three beats constitutes a 'measure.' The user must configure the device for operation in this odd time signature by depressing the footswitch.

The user interrupts the horizontal laser beam 104 with an initial upward stroke (x) of a hand or baton (x). This interruption does not represent an actual beat, but a preparatory beat. The interruption of horizontal beam 104 causes the voltage at the optical sensor to drop. This voltage drop functions as a control signal to start timer 706. The timer will record the elapsed time until the next interruption of the laser.

Next, the user delivers a downward (vertical) stroke 610 of the baton, interrupting horizontal laser beam 104. This stroke constitutes the first beat of the first measure of the musical passage. When the optical sensor transmits the control signal resulting from this stroke, the timer stops and restarts. The amount of time recorded by the timer constitutes the predicted duration of the first beat. MIDI Encoder 710 begins to send MIDI Beat Clock signals to computer 712 at a rate of 24 per beat, or one signal every (1/24) of the time recorded by the timer.

Next, the user delivers a rightward-moving (horizontal) stroke 620 of the baton, interrupting vertical laser beam 102. This stroke constitutes the second beat of the first measure of the musical passage. When the optical sensor transmits the control signal resulting from this stroke, the timer stops and restarts. The amount of time recorded by the timer constitutes the predicted duration of the second beat. MIDI Encoder 710 begins to send MIDI Beat Clock signals to computer 712 at a rate of 24 per beat, or one signal every (1/24) of the time recorded by the timer.

Next, the user delivers an upward (vertical) stroke 630 of the baton, interrupting vertical laser beam 102 and horizontal laser beam 104. This stroke constitutes the third beat of the first measure of the musical passage. When the optical sensor transmits the control signal resulting from the interruption of vertical laser beam 102, the control signal is suppressed by sequential logic 704, and never reaches timer 706. When the optical sensor transmits the control signal resulting from the interruption of horizontal laser beam 104, the timer stops and restarts. The amount of time recorded by the timer constitutes the predicted duration of the third beat. MIDI Encoder 710 begins to send MIDI Beat Clock signals to computer 712 at a rate of 24 per beat, or one signal every (1/24) of the time recorded by the timer.

The user has thusly conducted the first three beats (or first measure) of the musical passage. To begin the second measure of the piece, the user delivers a downward (vertical) stroke of the baton 610, interrupting the horizontal laser beam. This stroke constitutes the first beat of the second measure. Each measure of the musical passage can be conducted using the fundamental three gestures outlined above. These gestures form the common pattern that musical conductors use to conduct music in 3/4 time signature.

Operation of Other Time Signatures

The operation outlined above was relevant to pieces of music in the 4/4 time signature and the 3/4 time signature. A piece of music can theoretically be written in any time signature. A time signature consists of a quantity of beats per measure (the top number) and the length of one beat (bottom number).

The 2/4 time signature: This time signature is typically conducted with a downward stroke and an upward stroke. The device can be configured for this mode the same way it can be configured for operation in the 4/4 time signature.

The 2/2 time signature: This time signature is typically conducted with a downward stroke and an upward stroke. The device can be configured for this mode the same way it can be configured for operation in the 4/4 time signature.

The 3/2 time signature: This time signature is typically conducted with a downward stroke, a rightward stroke, and an upward stroke. The device can be configured for this mode the same way it can be configured for operation in the 3/4 time signature.

Uncommon time signatures: Suppose a piece of music were written in the 5/4 time signature. Suppose also that a user desires to conduct the piece of music using the following gestures: down, left, right, left, up. To accommodate this operation, the device could use a map to associate each 'cut' (interruption of a laser beam) with one of six expected cuts. The first cut would map to the first beat, and the second cut would map to the second beat. The third and fourth cuts would map to the third and fourth beats. The fifth cut would be unique in that it would not map to a beat. The fifth cut would be treated as rhythmically insignificant. The sixth cut, being the last cut in the map, would map to the fifth beat.

Description and Operation-Alternate Embodiments

Figure 7:
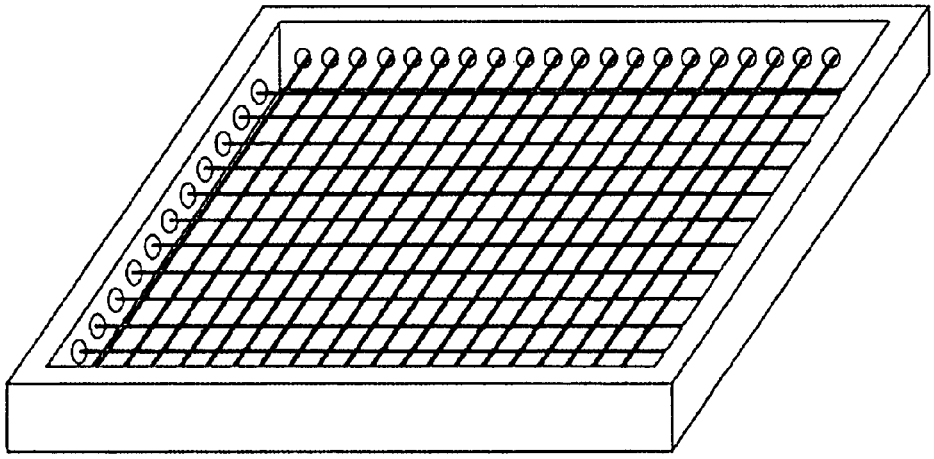
FIG. 7 is a perspective view of an alternate apparatus of a lattice of laser beams.

One alternate embodiment uses multiple parallel laser beams to detect motion of a baton or a hand, as shown in FIG. 7. Instead of detecting beats via interruptions of laser beams, this embodiment relies upon a lattice of laser beams to track the motion of a hand or baton. When a user conducts music with a baton, he breaks the laser beams of the lattice sequentially. However, when the user reaches a beat, he reverses the direction of the baton, creating a peak. This change of direction will result in one beam being broken twice in a row, and this will trigger a new beat. The construction of this embodiment is more elaborate than that of the main embodiment, because this embodiment requires that many lasers be aligned so that they project laser beams into optical sensors.

Conclusion, Ramifications, and Scope

Thus the reader will see that the present device is an efficiently operated, simply constructed conducting device. It is capable of accommodating many conducting patterns and tempos.

While the preceding description is specific, it does not intend to limit the scope of the invention. While the preferred embodiment of the conducting device has been described in detail, there are other possible variations and improvements that maintain the essence of the present invention. For example:

An embodiment of the device might use multiple laser projectors and multiple optical sensors to more exclusively discriminate beats. For example, two laser projectors could project beams into two optical sensors.

An embodiment of the device might use computer software to make predictions about the length of upcoming beats. These predictions might be based upon patterns recognized in previous beats or groups of beats. For example, a user might persist in making beats '1' and '3' of a piece of music in the 4/4 time signature longer, and beats '2' and '4' shorter. Software incorporated in the device might recognize this pattern and use it to adjust the length of new beats.

An embodiment of the device might derive velocity information from the laser interruptions by measuring the amount of time for which the laser beam is interrupted.

An embodiment of the device might rely on special MIDI player software to incorporate the function of the sequential logic 704. In this embodiment, the user would not be required to toggle the mode switch 450, because the MIDI player would automatically ignore laser interruptions that did not represent beats.

An embodiment of the device might incorporate the laser projector 100 into the laser detection unit 400. The laser projector would project a beam out of the detection unit, and the beam would be bounced back into the detection unit by a system of mirrors.

An embodiment of the device might send MIDI signals other than MIDI Beat Clocks. For example, the MIDI Encoder 710 could send a single note signal for each beat, rather than 24 equally spaced MIDI Beat Clocks. This embodiment could be useful for diversifying the functionality of the device, so that it could be used to trigger various MIDI signals in addition to tempo.

An embodiment of the device could replace the mirrors 202 and 302 with prisms.

An embodiment of the device could replace the laser projector 100, the towers 200 and 300, and the detection unit 400 with units designed to be mounted permanently in a musical space.

An embodiment of the device could incorporate the laser projector 100, the towers 200 and 300, and the detection unit 400 into a single unit suitable for easy transport.

An embodiment of the device could allow automated configuration of the laser. The laser projector 100, or the mirror pivots 202 and 302, or the optical sensor 700, or any combination thereof might be guided by servo motors.

An embodiment of the device might incorporate an entire 'kit' of mirror elements, laser projectors, optical sensors, and configurable sequential logic. This kit could be configured by a user to detect any set of conducting gestures or any tempo.

I claim:

1. Apparatus for detecting musical conducting gestures, comprising:

a. means for emitting at least one beam of radiation into an operational space, b. means for detecting discrete interruptions of said beams, said interruptions occurring within said operational space, c. means for associating said interruptions with the individual gestural beats of a known sequence of conducting gestures, d. means for generating a control signal representative of said musical beats.

2. The apparatus of claim 1 wherein the emission means comprise at least one laser.

3. The apparatus of claim 1 wherein at least one of the emission means is transmitted into reflective means, so that the operational space contains both direct and reflected beams of radiation.

4. The apparatus of claim 1 wherein certain interruptions of said beams are mapped to musical beats and other interruptions of said beams are not mapped to musical beats.

5. The apparatus of claim 1 wherein interruptions of said beams cause an advance of the state of a finite state machine, where said finite state machine contains states that represent individual musical beats.

6. The apparatus of claim 5 further comprising means for configuring said state machine to map any pattern of interruptions of said beams on to any pattern of musical beats.

7. A method for training a musical conductor, comprising the steps of:

a. configuring at least one beam of radiation so that each of a sequence of predetermined human gestures causes an interruption of at least one of said beams, b. inferring a stepwise musical tempo signal from successive delays between said interruptions, c. playing a musical sequence contemporarily with said gestures so that said tempo signal temporally governs the progression of said musical sequence.

8. The method of claim 7 wherein said beams of radiation are collimated beams, such that only parallel and perpendicular angles exist between said beams.

9. The method of claim 7 wherein said inference of tempo signal includes ignoring certain interruptions of said beams and acknowledging other interruptions of said beams.

10. An optical system for detecting musical gestures, comprising:

a. two collimated radiation beams related by a right angle, b. one or more sensors capable of detecting interruptions of said beams, c. sequential logic capable of relating interruptions of said beams to the beats of a known musical conducting pattern, d. one or more signal generators capable of playing a prerecorded musical sequence in synchronization with said beats.

11. The system of claim 10 wherein said sequential logic is capable of ignoring specific interruptions of said beams in accordance with a selected mode of operation.

12. The system of claim 10 wherein said sequential logic is configurable by a user, so that any given pattern of gestures can be mapped to a sequence of beats.

* * * * *